US005117670A

United States Patent [19]

Sartorio

[11] Patent Number: 5,117,670

[45] Date of Patent: Jun. 2, 1992

[54] PRESS BRAKE SYSTEM WITH A WORKSHEET STRAIGHTENING DEVICE

[75] Inventor: Franco Sartorio, Turin, Italy

[73] Assignee: Amada Company, Limited, Japan

[21] Appl. No.: 589,594

[22] Filed: Sep. 28, 1990

[30] Foreign Application Priority Data

Sep. 29, 1989 [IT] Italy ..... 67834 A/89

[51] Int. Cl.[5] ..... B21D 5/04

[52] U.S. Cl. ..... 72/384; 72/10; 72/389; 72/420; 72/461

[58] Field of Search ..... 72/10, 14, 15, 21, 384, 72/389, 461, 420, 422

[56] References Cited

U.S. PATENT DOCUMENTS

| | | | |
|---|---|---|---|
| 3,908,435 | 9/1975 | Bowman, Jr. et al. | 72/389 |
| 4,426,873 | 1/1984 | Pearson et al. | 72/389 |
| 4,986,101 | 1/1991 | Starner | 72/389 |
| 5,042,287 | 8/1991 | Sartorio | 72/422 |

FOREIGN PATENT DOCUMENTS

| | | | |
|---|---|---|---|
| 2382957 | 11/1978 | France | 72/461 |
| 67224 | 3/1988 | Italy . | |
| 50128 | 3/1983 | Japan | 72/389 |
| 11035 | 1/1989 | Japan | 72/461 |
| 63610 | 3/1990 | Japan | 72/461 |

*Primary Examiner*—David Jones
*Attorney, Agent, or Firm*—Wigman & Cohen

[57] ABSTRACT

A press brake system for bending, flanging, folding and forming an elongate and curved worksheet, and a worksheet handling device for handling such a worksheet are disclosed. The press brake system includes a press brake including a punch and a matrix which cooperate along a bending line in a working plane, and members for straightening an elongate and curved worksheet. The worksheet handling device includes members for straightening an elongate and curved worksheet. Such straightening members include: forcing members for applying force to the worksheet at central portion or end portions of a longitudinal edge, the force being in a direction perpendicular to the bending line and within a loading plane; and fixing members for fixing the worksheet so that it can not move against the force. This design enables the system to carry out appropriate bending or flanging to obtain a work with flanges of constant width along bending lines.

7 Claims, 7 Drawing Sheets

PRESS BRAKE SYSTEM WITH A WORKSHEET STRAIGHTENING DEVICE

BACKGROUND OF THE INVENTION

1. Field of the Invention

The present invention relates to a press brake system for bending, flanging, folding and forming a piece of sheet metal, particularly an elongate and curved worksheet, including a punch and a matrix which cooperate in a linear bending zone and at least one of which is movable towards the other and in the opposite direction in a working plane. The present invention also relates to a device and a method for straightening a curved worksheet and a device for handling such a worksheet.

2. Description of the Prior Art

A bending press which includes a device for handling sheet metal including gripper means for gripping an elongated piece of sheet metal and inserting the piece between the punch and the matrix along a loading plane substantially perpendicular to the working plane is known from Italian Patent Application No. 67224-A/88.

The press brake system according to the present invention is intended specifically for bending elongated pieces of sheet metal and in particular rectangular pieces which have one side much longer than the other (of the order of 1:10).

FIG. 2 of the appended drawings show in continuous outline a possible shape of a piece of sheet metal W which is to be bent or handled by a press brake system or a worksheet handling device according to the present invention. Due to technological problems related to the cutting of pieces of sheet metal, the pieces generally have an undesirable curved shape shown in broken outline in FIG. 2, with a concave longitudinal edge 2 and a convex longitudinal edge 4. This defect has been exaggerated in FIG. 2 in order to make the drawing more readily understood; the maximum difference F between the theoretical profile and the actual profile is generally between 0.2–2 mm for pieces of sheet metal with a length L of approximately 4 m.

As a result of this curvature, when the longitudinal edges 2 and 4 of the piece of sheet metal W are bent there is a variation in the widths of the resulting flanges between the central region of the piece of sheet metal W and the regions near its edges.

SUMMARY OF THE INVENTION

The object of the present invention is to provide means for straightening such a curved worksheet.

Another object of the present invention is to provide a press brake system and a worksheet handling device which avoids, or at least limits, the said problem.

According to the present invention, this object is achieved by the provision of a press brake system or a worksheet handling device characterised in that it includes means for straightening a curved worksheet by applying to it force being in a direction perpendicular to the bending line and in the loading plane on which the worksheet is loaded. The straightening means comprise forcing means for applying force to the worksheet at least at one portion of a longitudinal edge of the worksheet in the direction; and fixing means for fixing the worksheet to make it not move against the force. The forcing means cooperate with the fixing means in straightening and aligning the curved sheet when bending is carried out.

The design enables the system to carry out appropriate bending to obtain a work with flanges of constant width.

BRIEF DESCRIPTION OF THE DRAWINGS

The invention will become clearer from a reading of the detailed description which follows, with reference to the appended drawings, provided by way of non-limiting examples, in which.

DETAILED DESCRIPTION OF THE PREFERRED EMBODIMENT

Figure 1:
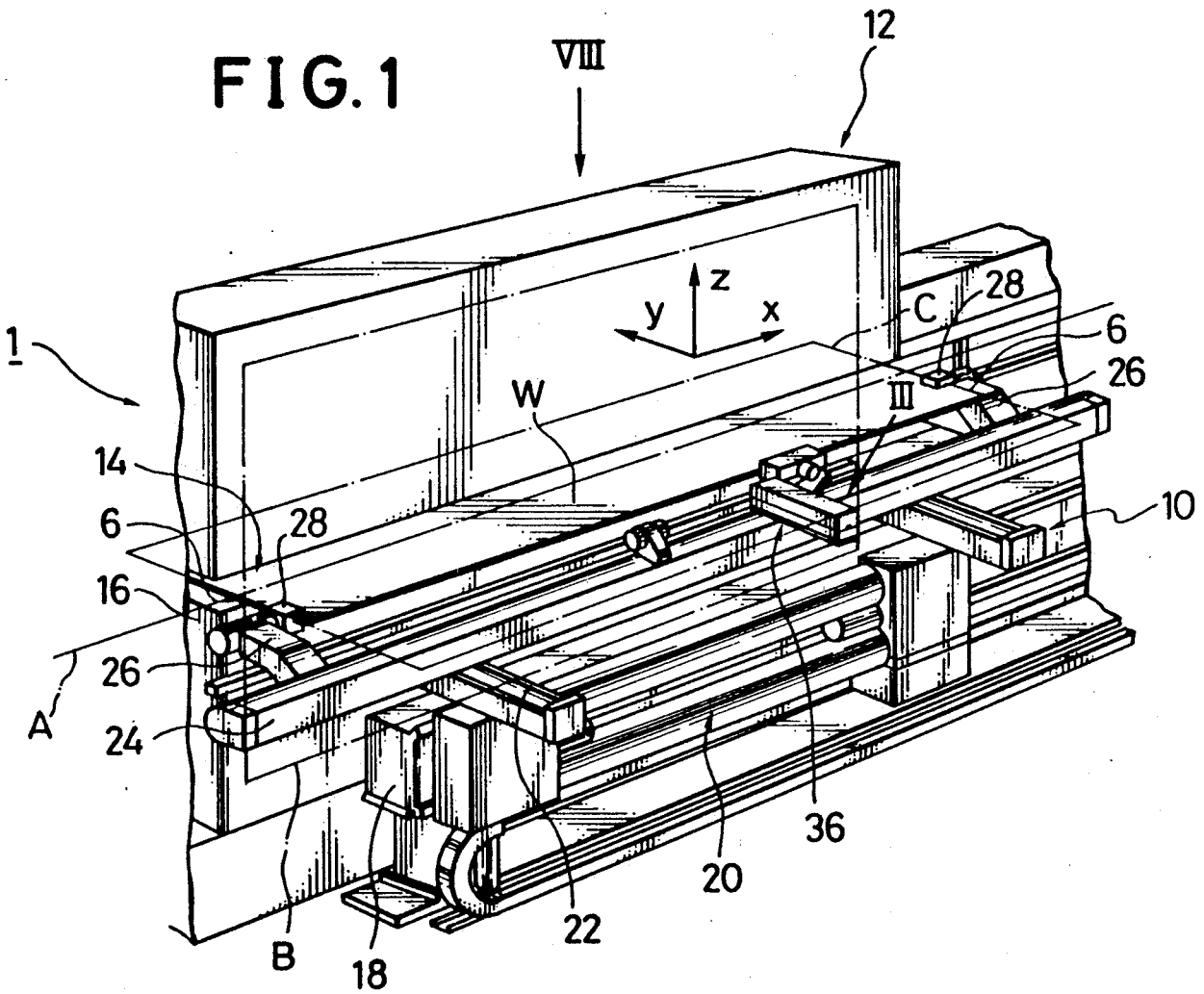
FIG. 1 is a schematic perspective view of a press brake system according to the present invention, which includes a worksheet handling device.

FIG. 1 shows three cartesian axis X-Y-Z and a press brake system 1 according to the present invention. A device 10, for handling worksheet W is intended to supply the sheets W to a press brake 12. The press 12 is constituted essentially by an upper die 14 (a punch) and a lower die 16 (a matrix) which cooperate along a bending line A.

The punch 14 is fixed whilst the matrix 16 is movable towards the other and in the opposite direction along a working plane indicated B.

The handling device 10 includes, in known manner, a support and guide beam 18 which extends parallel to the working plane B and is fixed to the floor. A carriage 20 is mounted for sliding on the beam 18 and is movable along the beam in the direction of the X axis. The carriage 20 carries a pair of transverse guides 22 which extend parallel to the Y axis, are movable in the direction of the Z axis and on which a cross member 24 is slidably mounted. Two arms 26, mounted for sliding on the cross member 24, are movable in the direction of the X axis and carry respective gripper heads 28, also of known type, for gripping tightly the shorter edges 6 of worksheet W to be handled.

Figure 2:
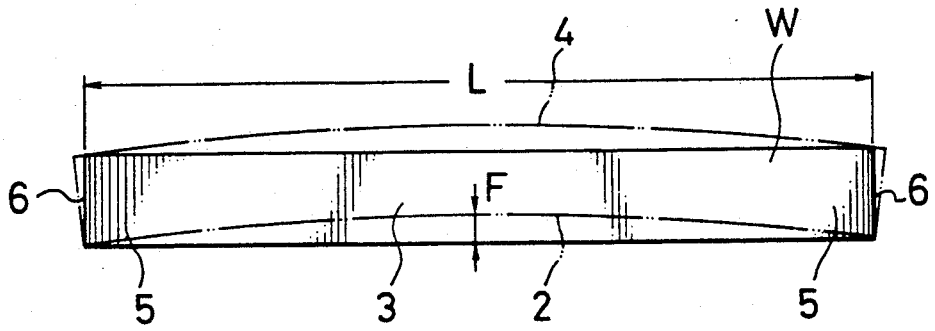
FIG. 2 is a plan view of a worksheet to be bent or handled by a press brake system or a worksheet handling device according to the present invention.
Figure 5:
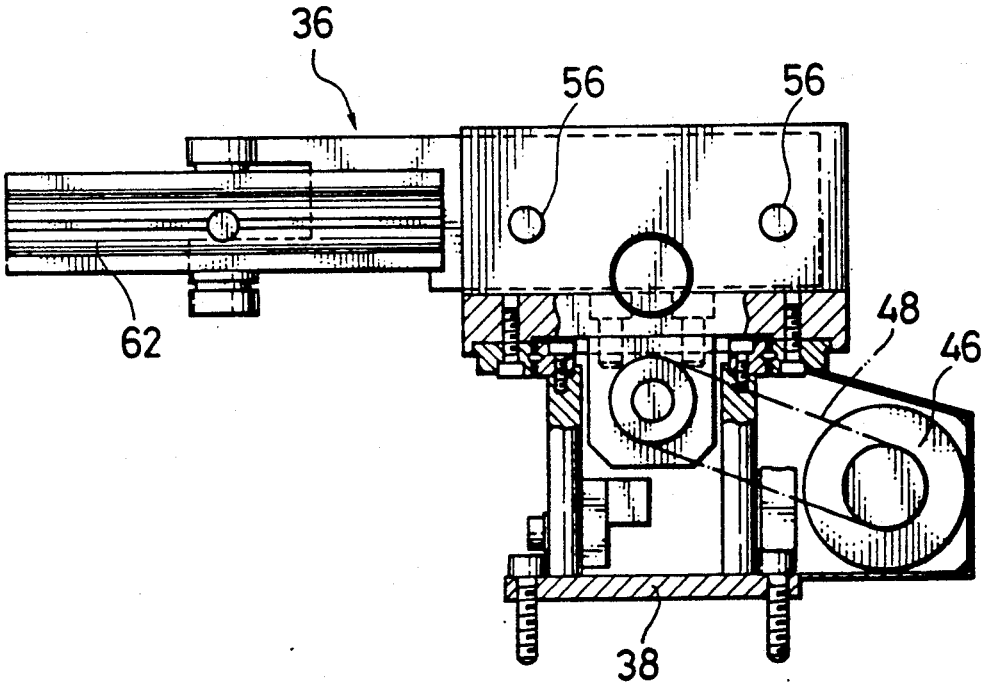
FIG. 5 is a view taken on the arrow V of FIG. 3, FIGS. 6 and 7 are sections taken on the lines VI—VI and VII—VII of FIG. 3, on an enlarged scale.

The worksheet W is presented to the press 12 in a loading plane C perpendicular to the working plane B with the concave longitudinal edge 2 of the sheet W (FIG. 2) facing the press brake 12.

Figure 8:
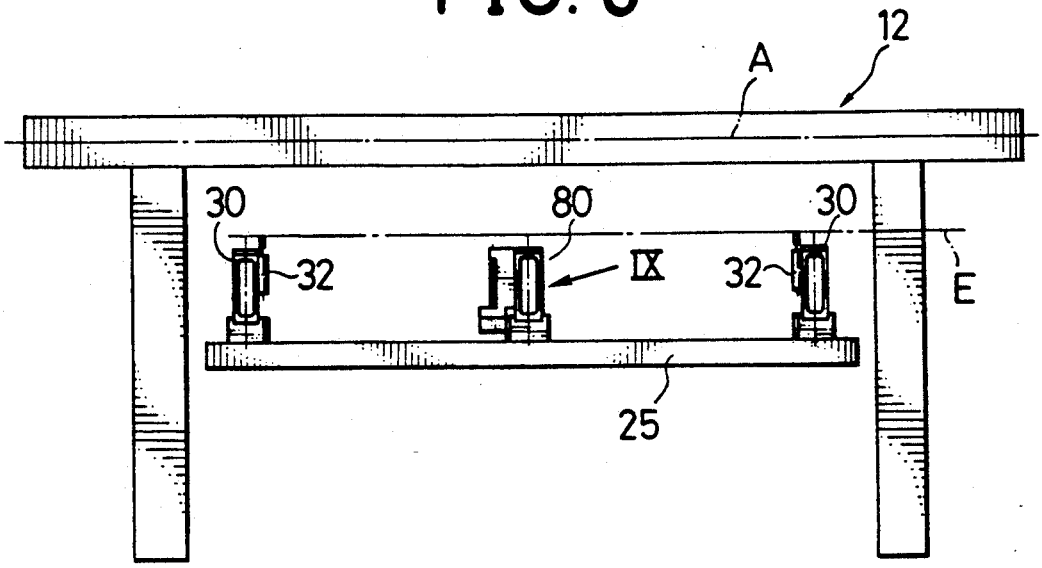
FIG. 8 is a plan view taken on the arrow VIII—VIII of FIG. 1.

As shown in FIG. 8, the press 12 has a pair of abutments 30 fixed parallel to the bending line A and provided with respective position sensors 32 against which the longitudinal edge 2 of the worksheet W bears. The sensors 32 are connected in known manner to actuators (not shown) for driving the cross member 24 and enable the longitudinal edge 2 of the worksheet W to be positioned parallel to the bending line A. The unit for orienting the cross-member 24 which positions the longitudinal edge 2 parallel to the bending line A is not described in detail in the present description since this unit falls outside the scope of the present invention. As regards the structural details of the orienting unit, reference is made to the Italian Patent Application No. 67224-A/88, mentioned above.

The handling device 10 according to the invention is provided with an auxiliary thrust device 36 which act as a forcing means for applying force to the worksheet W.

The thrust device 36 includes a base structure 38 fixed to the cross member 24 of the handling device 10. A carriage 40, mounted slidably on the base structure 38, is movable in the direction of the Y axis. The carriage 40 is driven by a nut 42 fixed to the carriage 40 and engaged with a screw 44 supported for rotation by the base structure 38. The screw 44 is rotatable by an electric motor 46 through a toothed belt 48. The base structure 38 has a pair of proximity sensors 50, 52 at its ends for detecting when the carriage 40 is at its travel-limit positions and for cutting off the supply to the electric motor 46 as a consequence.

Figure 6:
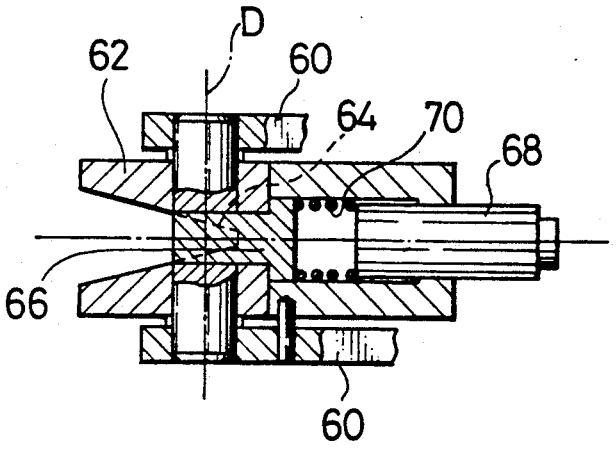

The carriage 40 has three guide rods 56 (FIG. 3) which extend in the direction of the Y axis and on which an end portion 58 of an arm 60 is slidably mounted. At its free end, the arm 60 carries a thrust member 62 which, as will become clear from the following description, is intended to cooperate with a central portion of the longitudinal edge 4 of the worksheet W. As can be seen in FIG. 6, the thrust member 62 is articulated to the end of the arm 60 about an axis D parallel to the Z axis. The thrust member 62 has a V-shaped cross-section with a base wall 64 against which the longitudinal edge 4 of the worksheet W is intended to bear. A piston 66 is slidable in the central part of the thrust member 62 facing a proximity sensor 68 whose function will be clarified below. A helical spring 70 is interposed between the piston 66 and the sensor 68.

Figure 7:
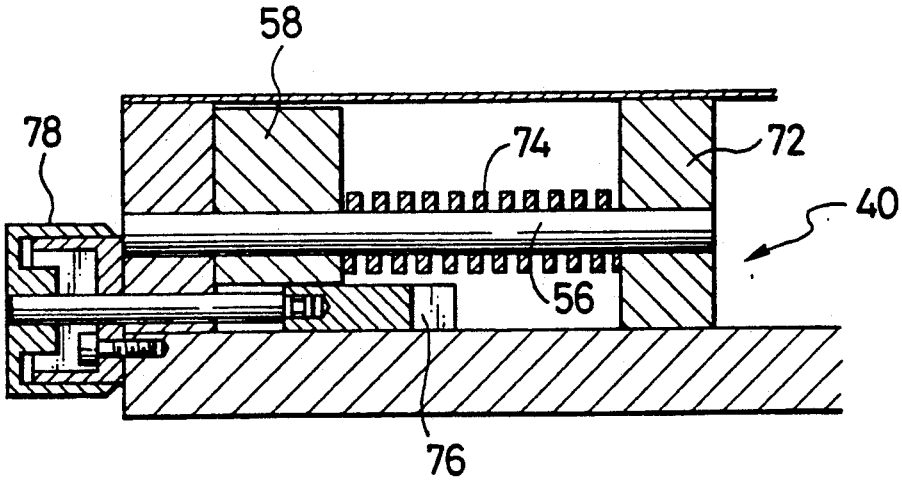

As can be seen from FIG. 7, a resilient means 74 such as a helical spring is interposed between the end portion 58 of the arm 60 and an abutment 72 fixed to the carriage 40 and is coaxial with one of the guide shafts 56. A proximity sensor 76 is also positioned between the end portion 58 and the abutment 72, its position being variable in the direction of the Y axis by means of a knob 78. When the end portion 58 of the arm 60 is in correspondence with the sensor 76, the latter detects its presence and consequently cuts off the supply to the electric motor 46.

Figure 9:
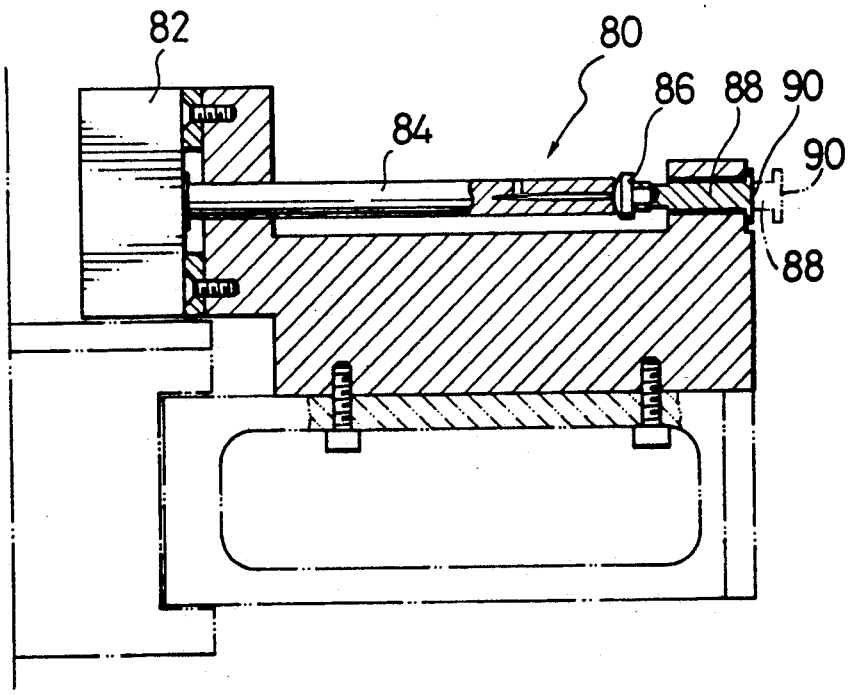
FIG. 9 is a partially-sectioned view of the part indicated by the arrow IX in FIG. 8, on an enlarged scale.

With reference to FIGS. 8 and 9, it can be seen that the press 12 has a third fixed abutment 80 arranged centrally between the two abutments 30 described above. As shown in FIG. 9, the abutment 80 includes a fluid actuator 82 with a rod 84 whose end face acts against a spherical head 86 of a piston 88. In the configuration shown in continuous outline in FIG. 8, the end surface 90 of the piston 88 is behind a line E parallel to the end faces of the abutments 30, 80. The line E passes through the ends of the sensors 32 which ensure that the line E is parallel to the ends of the abutments 30, 80 and therefore to the bending line A (FIG. 8). The activation of the actuator 82 brings the piston 88 to the configulation shown in broken outline in FIG. 9. In this latter configulation, the end surface 90 of the piston 88 is aligned with the line E.

The device described above operates as follows.

The handling device 10, driven by a control unit (not shown), grips a worksheet W by means of its gripper heads 28 and inserts it between the punch 14 and the matrix 16 along the loading plane C. The handling device 10 brings the longitudinal edge 2 (which, as already stated above, is the concave edge) to bear against the sensors 32 and aligns that edge with the line E parallel to the bending line A.

The actuator 82 is then activated and brings the surface 90 of the piston 88 into alignment with the line E. The electric motor 46 is then activated and advances the carriage 40 and the thrust member 62 in the direction of the Y axis. The thrust member 62 comes into contact with the longitudinal edge 4 (the convex edge) of the worksheet W. Immediately before the longitudinal edge 4 hits the base wall 64 of the thrust member 62, the piston 66, thrust by the edge 4 of the worksheet W, moves towards the sensor 68 against the action of the spring 70. When the sensor 68 detects the presence of the piston 66, it switches off the electric motor 46 for a short period of time so that the movement of the carriage 40 is slowed before the thrust member 62 strikes the longitudinal edge 4 of the worksheet W. The sensor 68 has the further function of detecting that the worksheet W is engaged correctly with the thrust member 62.

Figure 3:
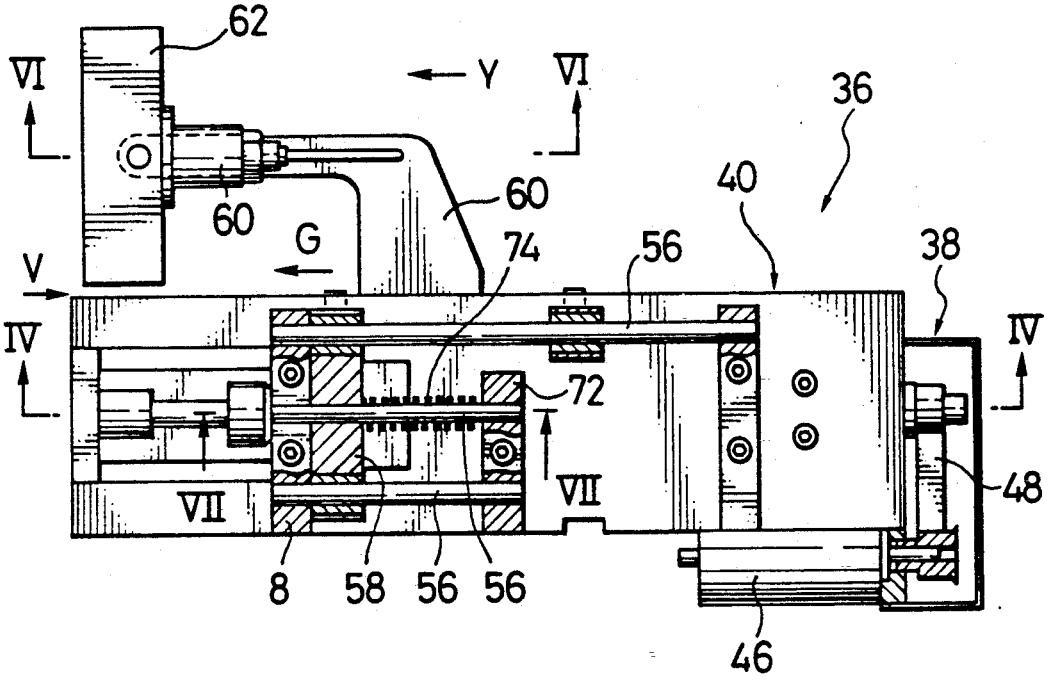
FIG. 3 is a partially-sectioned plan view of forcing means indicated by the arrow III of FIG. 1.
Figure 4:
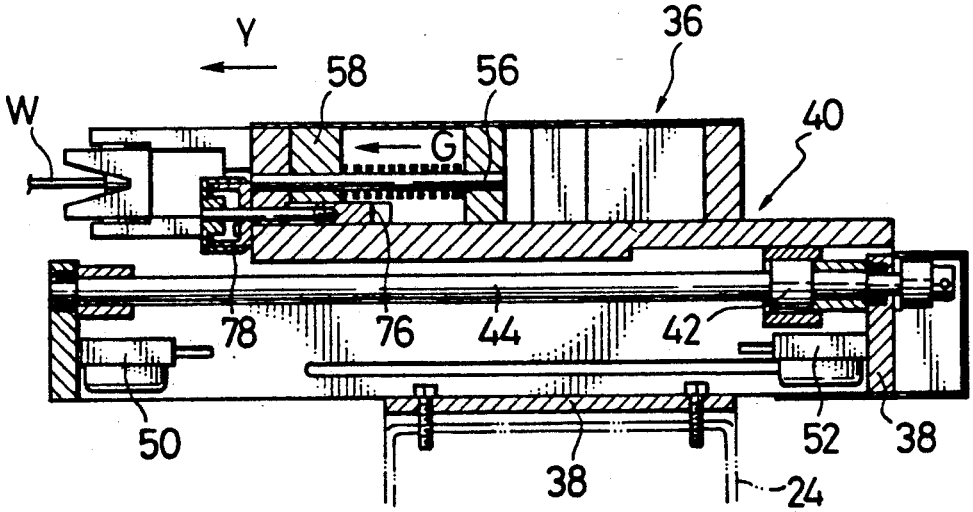
FIG. 4 is a section taken on the line IV—IV of FIG. 3.

After the interruption caused by the sensor 68, the motor 46 is supplied again and the carriage 40 continues to move towards the press 12. The arm 60, on the other hand, stops at the moment when the thrust member 62 comes into contact with the longitudinal edge 4 of the worksheet W. As a result of the relative movement between the carriage 40 and the end portion 58 of the arm 60, the spring 74 is loaded and transmits force to the arm 60 in the direction of the arrow G (FIGS. 3 and 4). The force of equal magnitude is therefore transmitted by the thrust member 62 to the worksheet W.

This force acts in the loading plane C and tends to compensate for the effect of the curvature of the worksheet W. As a result of the thrust exerted by the member 62, the longitudinal edge 2 of the worksheet W will, at most, be brought into contact with the surface 90 of the central abutment 80. When the end portion 58 of the arm 60 is in correspondence with the position sensor 76, the latter cuts off the supply to the electric motor 46. It is therefore possible, by varying the position of the sensor 76 by means of the adjustment knob 78, to vary the magnitude of the load which is transmitted by the thrust member 62 to the worksheet W. The optimum thrust can be determined experimentally in dependence on the dimensions of the worksheet W and on the material from which it is made.

During the stage in which force is applied by the member 62, the worksheet W is held by the gripper heads 28 of the handling device 10. The greater part of the force exerted by the thrust member 62 is therefore discharged through the worksheet W to the gripper heads 28 and hence to the cross member 24. The force exerted by the thrust member 62 is therefore discharged without affecting the drive units of the handling device 10 and therefore without affecting the alignment of the worksheet W which is achieved, as described above, by means of the sensors 32.

Although in FIGS. 1–9 there shown is a forcing means 36 which has a thrust device 36 with a thrust member 62, a forcing means according to the present invention may includes alternatively a thrust device 36 with two or more thrust members 62 or a plurality of thrust devices 36 with one or more thrust members 62.

Furthermore, in the explanation which has been made above about an example of a press brake system or a worksheet handling device of the present invention, the worksheet W is set in the loading plane C with its concave longitudinal edge 2 facing the press brake 12, and at least one central portion of the convex longitudinal edge 4 is thrust by the forcing means, however, in the opposite way to this, it is possible to set the worksheet W in the loading plane C with its convex longitudinal edge 4 facing the press brake 12, and two end portions 5 of the concave longitudinal edge 2 are thrust by two or more forcing means. In this case it is preferable to provide means for fixing the worksheet W at least at its one central portion 3 and sensor means 30 and 32 near the fixing means with which the central portion 3 of the convex edge 4 comes into contact. The alignment of the worksheet W is carried out in a way similar to one mentioned above.

Figure 10:
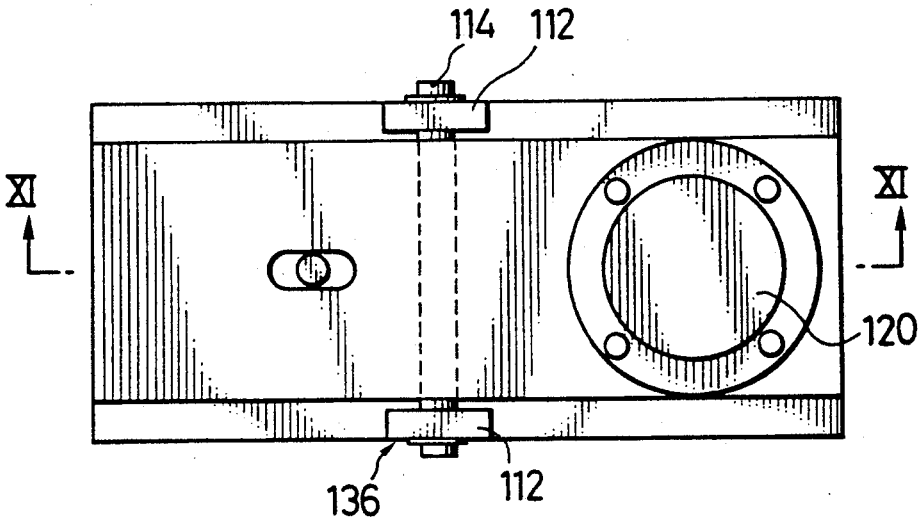
FIG. 10 is a plan view of an alternative forcing means utilised in a press brake system according to the present invention.
Figure 11:
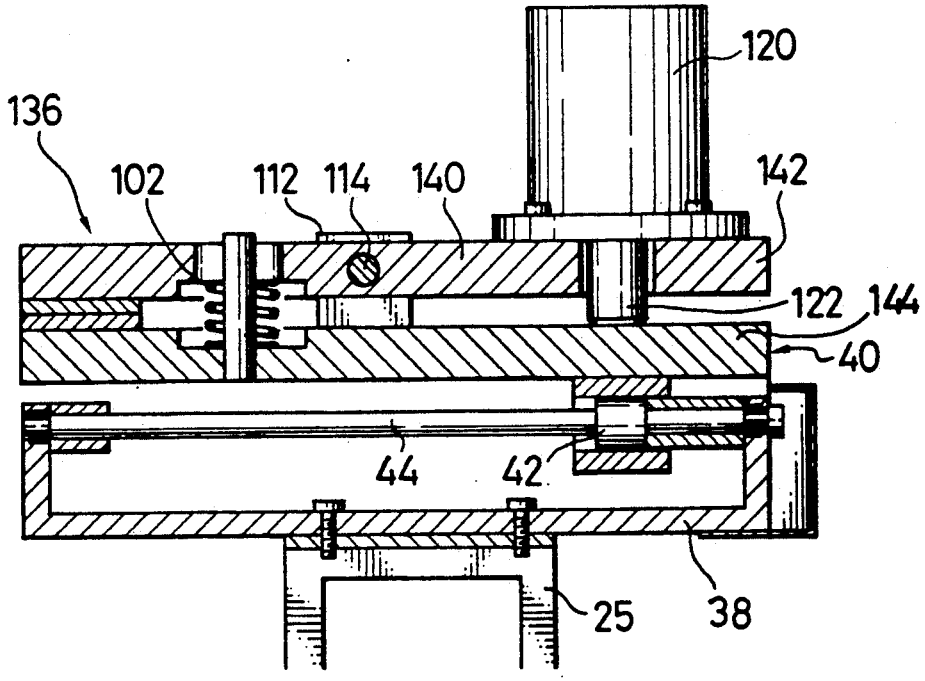
FIG. 11 is a section taken on the line XI—XI of FIG. 10.

In the FIGS. 10 and 11, an alternative forcing means 136 utilized in a press brake system is shown. The forcing means 136 mounted on a member which is, for example, a member 25 of a press brake of the system and which extends along a line parallel to the bending line A (see FIG. 8), pulls a worksheet W to straighten it. The forcing means 136 includes a carriage 40 and a base structure 38. The base structure 38 is fixed to a nearly central portion of the member 25. The carriage 40 mounted on the base structure 38 slides in the direction of the Y axis. The carriage 40 is driven by a nut 42 fixed to the carriage 40 and engaged with a screw 44 supported for rotation by the base structure 38. The screw 44 is rotatable by an electric motor (not shown) in the same way mentioned above.

The carriage 40 includes a pair of pincers 140 and a cylinder 120. A piston (not shown) of the cylinder 120 is actuated by an actuating means (not shown). When the piston is actuated a piston rod 122 extrudes and push a lower pincer 144. Consequently, an upper pincer 142 rotates anticlockwise about a pin 114 of which ends are fixed to brackets 112, and the front portions of the pincers 140 are closed tightly to grip a concave longitudinal edge 2 of a worksheet W. FIG. 11 shows the closed state of the pincers 140. When the actuation is released the front portions of the pincers 140 open by the action of a spiral spring 102.

In process of bending by a press brake system utilizing the forcing means 136, a worksheet W is set by appropriate means in the loading plane C of a press brake of the system with a concave longitudinal edge 2 of the worksheet W facing the press brake and end portions 5 of the edge 2 being made contact with fixing means of abutments 228. After the setting of the worksheet W, the carriage 40 is driven to edge 2 by actuating carriage driving means such as the motor, the transmission belt, the screw 44 and the nut 42, and then the front portions of the pincers 140 is opened. Then the carriage is advanced again by a certain amount, and the front portions of the pincers are tightly closed each other to grip a central portion 3 of the concave longitudinal edge 2. The carriage driving means are, then, actuated and the forcing means 136 pulls the worksheet W. Two abutments 228 act as fixing means for fixing the worksheet W against force applied by the forcing means 136. The forcing means 136 cooperates with the abutments 228 in straightening and aligning the worksheet W. When the worksheet W is straightened correctly the longitudinal edge 4 comes into contact with a top surface of another abutment 280 (FIG. 12) which is displaced in the middle of the two abutments 228. The top surface of the abutment 280 is aligned with the line E parallel to the bending line A.

In FIGS. 10 and 11, means comprising the herical spring 74, the proximity sensor 76 and the knob 78 for adjusting the strength of force to pull the worksheet W are omitted. However, the forcing means 136 may include such strength-of-force adjusting means, for example, between the carriage 40 and the base structure 38.

Figure 12:
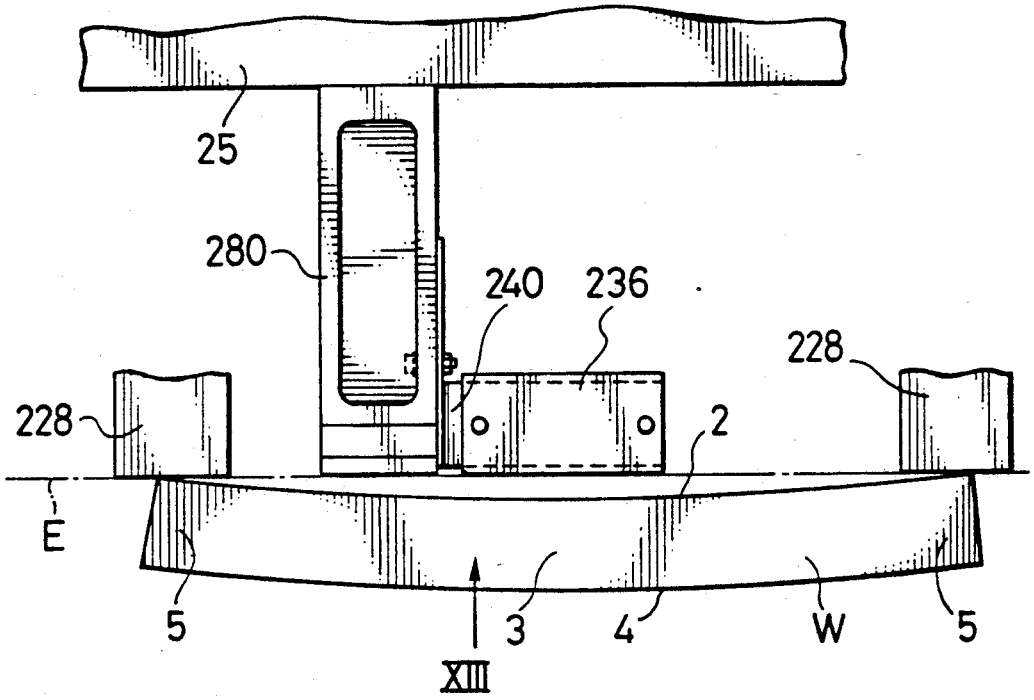
FIG. 12 is a plan views of an alternative means for straightening a worksheet utilised in a press brake system according to the present invention.
Figure 13:
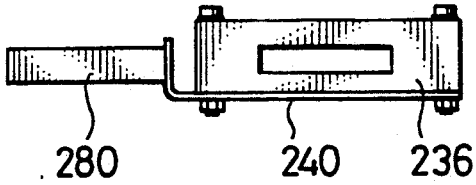
FIG. 13 is a side view taken on the arrow XIII of FIG. 12.

In FIGS. 12 and 13, another alternative forcing means is shown. The means includes an electromagnet 236 mounted on a bracket 240 which is fixed to a abutment 280. The abutment 280 is fixed to a member 25 which is a member of a press brake or a member independent from the press. In this embodiment, a worksheet W is set against fixing means 228 in the same manner as mentioned above. When electric power is supplied to the magnet 236 it draws the worksheet W to straighten it. When the worksheet W is straightened correctly the longitudinal edge 4 comes into contact with a top surface of another abutment 280 which is displaced in the middle of two abutment 228. The top surface of the abutment 280 is aligned with the line E parallel to the bending line A.

In the above description relating to FIGS. 10 to 13, each forcing means 136 and 236 for pulling the concave longitudinal edge 2 of the worksheet W is mounted on the member 25 near the press brake. However, it is, of course possible in the present invention to attach one of these forcing means 136 and 236 for pulling the worksheet (W) to the cross member 24 shown in FIG. 1. In this case, the worksheet (W) is set in the loading plane C with the convex longitudinal edge 4 facing the press brake 12 and the end portions 5 of the concave longitudinal edge 2 are fixed by the pair of gripper heads 28 or other appropriate fixing means. The fixing means may align the worksheet W.

Similarly, it is possible to attach the thrust device 36 to the member 24.

Naturally, the principle of the invention remaining the same, the forms of embodiments and details of construction may be varied widely with respect to those described and illustrated, without thereby departing from the scope of the present invention.

What is claimed is:

1. A press brake system having a punch and a matrix which cooperate in a bending line in bending a worksheet inserted between the punch and the matrix and at least one of which is movable toward and away from the other in a working plane, comprising forcing means, disposed adjacent to the bending line, for applying a deforming force in a direction substantially perpendicular to said workingplane to at least one portion of at least one longitudinal edge of an elongated and curved worksheet, said worksheet being curved along a longitudinal edge thereof, and fixing means located on an edge of said worksheet opposite said force applying means for providing a reaction force against the applied force, thereby curvature of said worksheet is compensated and said worksheet is straightened when said worksheet is subject to bending by the punch and the matrix.

2. The press brake system of claim 1, wherein said fixing means comprises abutments against which said worksheet is pressed in said force applying direction and at which said worksheet is positioned when said force is applied to said worksheet.

3. The press brake system of claim 1, wherein said forcing means comprise at least one electromagnet.

4. A device for handling worksheets for a press brake having a punch and a matrix which cooperate in a bending line in bending a worksheet inserted between the punch and the matrix and at least one of which is movable toward and away from the other, comprising forcing means, mounted on said device and disposed adjacent to the bending line, for applying a deforming force in a direction substantially perpendicular to said working plane to at least one longitudinal edge of an elongated and curved worksheet, said worksheet being curved along a longitudinal edge thereof, and fixing means, located on an edge of said worksheet opposite said force applying means for providing a reaction force against said applied force, thereby curvature of said worksheet is compensated when said worksheet is subject to bending by the punch and the matrix.

5. A device for handling worksheets for a press brake having a punch and a matrix which cooperate in a bending line in bending a worksheet inserted between the punch and the matrix and at least one of which is movable toward and away from the other, comprising forcing means mounted on said device and disposed adjacent to the bending line for applying force in a direction substantially perpendicular to said working plane to at least one longitudinal edge of an elongated and curved worksheet, and fixing means, located on an edge of said worksheet opposite said force applying means, for providing a reaction force against said applied force, said forcing means comprising a carriage movable in said direction for applying said force to thrust said worksheet, driving means for causing said carriage to move in said direction to give said thrust force to said worksheet, resilient means through which said thrust force by said driving means is transmitted to said carriage, and a sensor for detecting the presence of said carriage contacting said resilient means due to a reaction of thrusting said worksheet and deactivating said driving means for a short period of time, said sensor being adjustable to stay in various positions along said resilient means, thereby the intensity of said thrust force is changed, thereby curvature of said worksheet is compensated by straightening when said worksheet is subject to bending by the punch and the matrix.

6. The device of claim 5, wherein said carriage has at its free end a contact member rotatable about a vertical axis, thereby said carriage contacts and thrusts said worksheet effectively.

7. A device attachable to a press brake to associate with the press brake in straightening an elongated piece of sheet metal curved in an elongated dimension thereof when the sheet metal is bent by the press brake, comprising:

a base structure;

a carriage slidably mounted on said base structure to move in a direction perpendicular to a bending line of the press brake to thrust an elongated edge of the sheet metal on the press brake to compensate for curvature of the sheet metal during bending of the sheet metal by the press brake;

driving means for moving and applying thrust force to said carriage in said perpendicular direction; resilient means through which said thrust force of said driving means is transmitted to said carriage;

fixing means, located on an edge of said sheet metal opposite said driving means, for providing a reaction force to said thrust force; and a sensor for detecting the presence of said carriage contacting said resilient means due to said reaction force caused by thrusting said edge of the sheet metal and for deactivating said driving means for a short period of time, wherein said sensor is changeably positioned along said resilient means, thereby intensity of said thrust force to be applied to a piece of metal is capable of being varied.

* * * * *